United States Patent [19]

Negley

[11] Patent Number: 4,518,209

[45] Date of Patent: May 21, 1985

[54] CONNECTOR BLOCK WITH RF SHIELD

[75] Inventor: Loren E. Negley, Carlisle, Pa.

[73] Assignee: Welcon Connector Company, New Cumberland, Pa.

[21] Appl. No.: 509,404

[22] Filed: Jun. 30, 1983

[51] Int. Cl.[3] ..... H01R 4/66; H01R 13/648

[52] U.S. Cl. ..... 339/14 R; 339/17 LC; 339/143 R

[58] Field of Search ..... 339/14 R, 17 LC, 136 R, 339/136 M, 138, 139 R, 139 C, 143 R

[56] References Cited

U.S. PATENT DOCUMENTS

| | | | |
|---|---|---|---|
| 2,169,961 | 8/1939 | Del Camp | 173/332 |
| 2,169,962 | 8/1939 | Del Camp | 173/332 |
| 2,790,153 | 4/1957 | Arson | 339/184 |
| 3,277,426 | 10/1966 | Klostermann | 339/192 |
| 3,366,918 | 1/1968 | Johnson et al. | 339/143 |
| 3,535,676 | 10/1970 | Schultz | 339/143 |
| 3,977,755 | 8/1976 | Edel et al. | 339/143 |
| 4,072,401 | 2/1978 | Instone | 339/125 |
| 4,337,989 | 7/1982 | Asick et al. | 174/35 C X |
| 4,371,226 | 2/1983 | Brancaleone | 339/143 R X |
| 4,418,972 | 12/1983 | Benasutti | 339/14 R |
| 4,457,576 | 7/1984 | Cosmos et al. | 339/143 R |

OTHER PUBLICATIONS

AMP Catalog–Accessories Section, pp. 37 through 44.
3–Page Burndy Catalog.
5–Page ITT Cannon Catolog.
4–Page Honda Catalog.
3M Catalog Page.

*Primary Examiner*—John McQuade
*Assistant Examiner*—Steven C. Bishop
*Attorney, Agent, or Firm*—James D. Hall

[57] ABSTRACT

A right angle connector block with an improved metal radio frequency interference shield.

8 Claims, 6 Drawing Figures

CONNECTOR BLOCK WITH RF SHIELD

The invention relates to a connector block with specialized radio frequency shield.

Govermental regulation and proper design procedure requires that electronic elements which generate radio frequency interference radiation be properly shielded to prevent this radiation from leaking and undesirably affecting other circuitry. Leakage is prevented by completely surrounding circuits likely to generate radio frequency interference radiation with a ground plane shield. However, in most applications it is necessary to connect shielded circuitry to other circuitry, usually by interconnect cables and the like. Cables used for this purpose are frequently removably secured to the shielded circuitry at the surrounding ground plane shield through the use of connector block extending through the shield.

The present invention relates to an improved shielded electrical connector block. The connector block includes a metal shield which surrounds the nose of the connector block extending through the ground plane shield for making a reliable ground connection with a metal shielding shell on the header carried on the end of an interconnect cable or other circuit element. The connector block is preferably mounted on a printed circuit board and carries terminals soldered to circuit lines on the board. The grounding shield is secured to the connector block and is in direct electrical connection with a grounded printed circuit line on the circuit board.

The shield is particularly adapted for mounting on a conventional D-sub miniature right angle connector block currently in use for forming electrical connections between innerconnect cables and shielded computer modules and other circuitry likely to generate radio frequency interference radiation.

D-sub miniature blocks are conventionally shielded by a flat shield which rests upon the face of the block and includes a extruded barrel fitted closely around the nose. The shield is secured to nose flanges of the block by screws which extend through holes in the shield plate and into threaded metal inserts molded in the nose flanges. Grounding of the shield is achieved by a wire or braid conductor sandwiched between the front of the block and the shield plate and extending to the rivet which holds the block on the circuit board. The rivet connects the conductor to ground plane circuitry on the board. This type of ground connection is both expensive and unreliable. The threaded inserts molded into the connector block must be hand loaded into the plastic molds, before the connector block is formed. This adds both part and labor expense to the cost of the block. The connections between the conductor and the shield and circuitry on the board frequently introduce resistance into the ground plane circuitry thereby decreasing the efficiency of the shield surrounding the connector nose and that of the header mating with the connector. Positioning and clamping of the conductor in place to form the ground connection is labor intensive.

A second type of grounding shield has been proposed for use with a D-sub miniature block. This shield includes a front plate and barrel of the type previously described with members positioned on the back of the connector block nose flanges. The members and shield are held in place by a suitable nut and bolt or rivet connection extending through mounting holes formed in the shield, flange and members. The members includes a solder tab which extend into a circuit board hole so that upon wave soldering of the board an electrical connection is formed between the member and a ground plane circuitry on the board. This type of a grounding shield includes a large number of parts and requires considerable labor for proper assembly. Additionally, the bolt or rivet connections holding the members to the block may introduce undesirable resistance into the ground plane circuitry.

Other conventional connector block shields including a flat plate which rests flush upon the front of the connector block with an integral extruded barrel which is fitted around the nose extending from the block are shown in U.S. Pat. Nos. 2,790,153; 3,277,426 and 3,535,676. These shields are conventionally secured to the connector block by connections extending through openings formed in the block and shield plate to either end of the nose.

The connector of the present invention is a block like the conventional D-sub miniature right angle connector block with an improved stamp formed shield secured to the block. The shield includes a flat plate which rests on the front of the block and carries an extruded nose barrel that fits closely around the nose of the block while permitting mating with a conventional pin header of the type connected to a circuit element, for instance the end of an innerconnecting cable. Circuit board mounting tabs join the bottom of the shield plate to either side of the barrel and extend away from the plate at right angles in a direction away from the barrel. L-shaped mounting lugs join the plate at the longitudinal ends of the plate and include flange mounting tabs which are bent around the connector block nose flanges and overlie the back of the flanges. The mounting lugs also include circuit board flange tabs which overlie the top of the block circuit board flanges. Mounting holes extend through the longitudinal ends of the shield plate are aligned with mounting holes extending through the nose flanges and screw stars formed in the flange tabs on the back of the nose flanges. In this way, the shield is physically secured on the block by screws extending through the plate with threaded shanks engaging the screw stars. The block in turn is mounted on the circuit board by rivets or similar connectors which extend through mounting holes in the circuit board mounting and flange tabs and circuit board flanges so that the circuit board tab is held flush against a ground plane circuit line on the board to establish a direct low resistance connection with the shield. If a soldered ground connection is desired, solder tab may extend from one of the mounting tabs into a circuit board hole in electrical connection with the ground plane on the board so that a soldered connection is formed therebetween when the circuit board is wave soldered.

A flat shield preform is stamped from sheet metal stock and includes the shield plate with the extruded nose barrel extending from one side of the plate. Two circuit board mounting tabs extend from one side of the plate and two L-shaped mounting lugs extend from the ends of the plate with the ends of the lugs projecting to the same side of the preform as the mounting tabs.

Following bending of the circuit board mounting tabs and flange mounting tabs at the end of the lugs up 90 degrees so they extend away from the plate in the opposite direction from the nose barrel, the preform is positioned on a D-sub miniature-type connector block such that the barrel surrounds the connector block nose and the plate is flush on the front of the block. The bent up board mounting tabs are flush against the bottom of the circuit board flanges. The L-shaped lugs are then bent around the ends of the block nose flanges, thereby completing initial mounting of the shield on the block.

The preform is provided with mounting holes extending through the plate, board lugs and flange mounting tabs in the L-shaped lugs and the block is provided with mounting holes extending through the nose and board flanges such that when the shield is in place on the block the block may be physically attached to a circuit board by positioning the free ends of the terminals in the block in circuit board holes and extending rivets through holes in the circuit board, board flanges and board mounting tabs. Likewise, the shield is secured to the front of the block by screws extending through holes in the front plate, the block nose flanges and threadably engaging screw stars in the mounting tabs on the back of the flanges.

The preformed radio frequency shield is easily mounted on the connector block by simply bending in the L-shaped parts, riveting the assembly to the circuit board and threadably engaging the two screws extending to the front of the block. This operation is easily performed on a production line basis and involves a reduced number of parts and reduced labor. A reliable ground connection is formed between the shield and ground circuitry on the circuit board.

Other objects and features of the invention will become apparent as the description proceeds, especially when taken in conjunction with the accompanying drawings illustrating the invention, of which there are two sheets and one embodiment.

IN THE DRAWINGS

Figure 1:
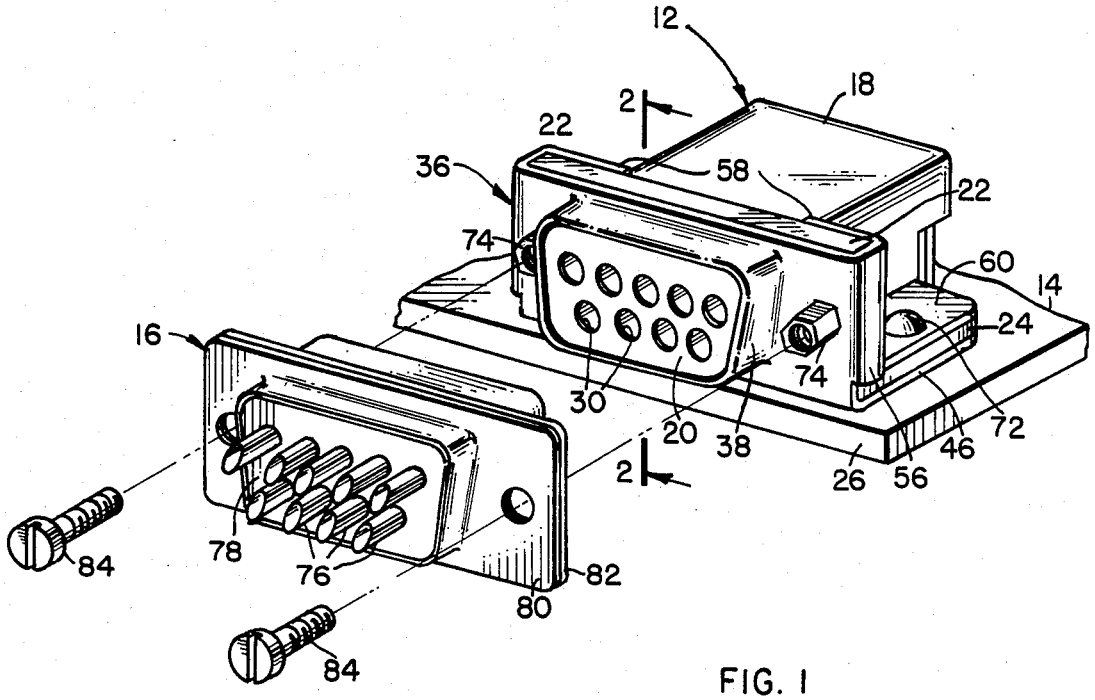
FIG. 1 is a prespective view of a connector assembly including a right angle connector block mounted on a circuit board and a pin header which mates with the block.

The connector assembly 10 shown in FIG. 1 includes a right angle connector block 12 mounted on circuit board 14 and a plug connector 16 engagable with block 12. The block 12 includes a conventional dielectric body 18 having an elongate nose 20 extending from one side of the body, nose flanges 22 extending outwardly of the body to either end of the nose and circuit board flanges 24 on either side of the body below the nose flanges. The nose and circuit board flanges extend perpendicular to each other and are joined together adjacent the front of the body.

The body 18 is provided with two rows of terminal recesses 28 extending from openings 30 in the front face of nose 20 to the back of the body. Formed metal terminals 32 are fitted in the recesses 28 and include contacts in the nose and 90 degree tails which bend down from the body and extend through contact holes 34 formed in board 14. The tails are soldered to printed circuitry on board 14.

Figure 6:
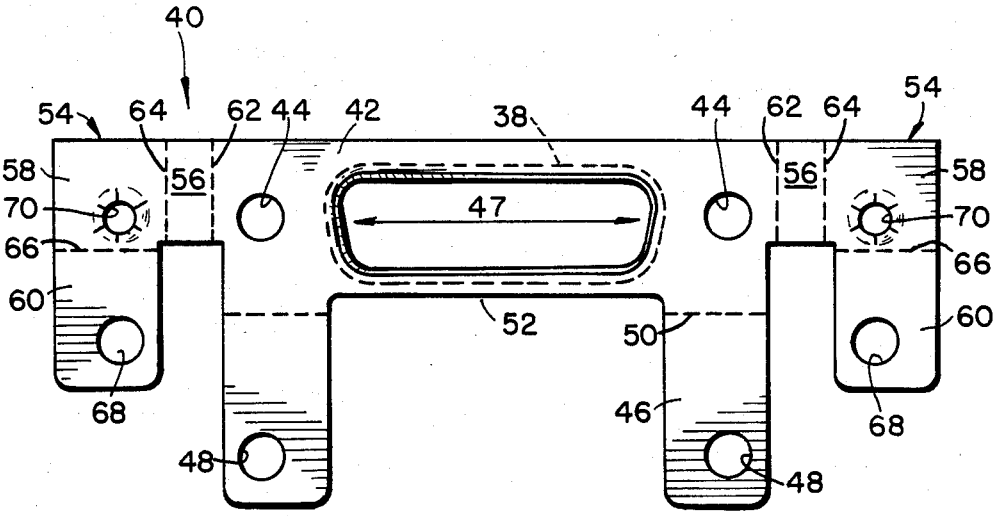
FIG. 6 is a view of a flat shield preform with extruded barrel.

A stamped metal radio frequency shield 36 is attached to the body of connector block 12 and includes an extruded elongate barrel 38 fitted around the connector block nose 20 as shown. FIG. 6 illustrates a flat shield preform 40 including a flat central mounting plate 42 surrounding the extruded barrel 38. The barrel has a shape conforming to the shape of nose 20. Exterior mounting holes 44 are provided through plate 42 to either end of the barrel 38. Straight circuit board tabs 46 at each end of plate 42 extend away from the plate perpendicularly to the longitudinal axis 47 of the barrel. Mounting holes 48 are provided in the ends of tabs 46. Bend creases 50 separate the tabs from the plate. A recess 52 is provided in the plate between the two creases 50.

L-shaped mounting lugs 54 are integral with plate 42 at the ends thereof and each includes a flange end cover 56, a nose flange mounting tab 58 and a circuit board flange mounting tab 60. The flange end cover 56 is joined to plate 42 and to the nose tabs by bend creases 62 and 64 which extend perpendicular to the longitudinal axis 47 of barrel 38. The circuit board tab 60 is joined to tab 58 by a bend crease 66 extending parallel to the longitudinal axis of the barrel. Mounting holes 68 are formed through tab 60 and screw stars 70 are provided in tabs 58. Tabs 46 and 60 extend in the same direction perpendicularly away from longitudinal axis of barrel 38 with free ends on the same side of the preform 40. The creases 50, 62, 64 and 66 are formed on the side of the preform away from the barrel 38.

Figure 3:
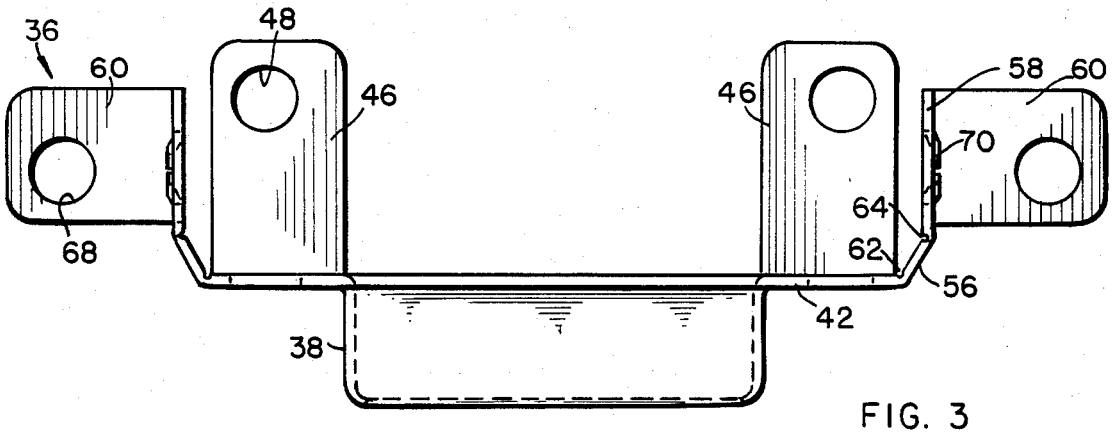
FIGS. 3, 4 and 5 are top, front and side views respectively of a radio frequency shield mounted on the block of FIG. 1.
Figure 4:
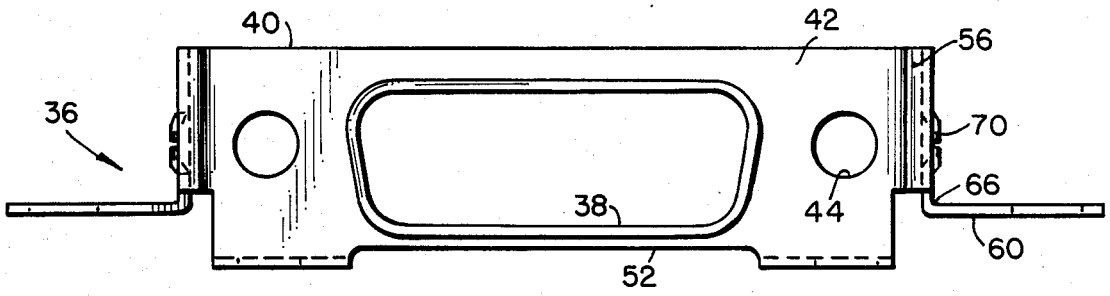
Figure 5:
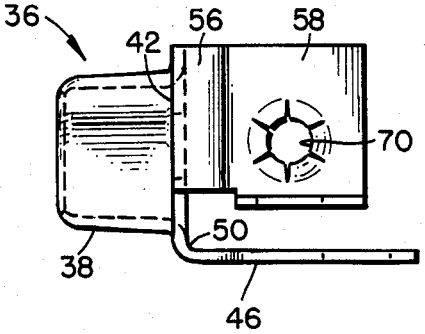

FIG. 3, 4 and 5 illustrate a preform 40 partially bent for mounting on connector body 18. In these Figures the circuit board mounting tabs 46 have been bent through 90 degrees about creases 50 so that they extend perpendicularly away from plate 42 in a direction opposite from the direction barrel 38 extends from the plate. Tabs 60 have been bent through 90 degrees about creases 66 and extend at right angles outwardly from tabs 58 so that they are parallel to but located outwardly of tabs 46. The lugs 54 have been bent through shallow angles about creases 62 and 64 so that tabs 58 are adjacent tabs 46 as shown in FIG. 3.

With the preform shaped as shown in FIGS. 3, 4 and 5, it may be placed on connector body 18 by fitting the barrel over the nose 20 so that the inner surface of plate 42 rests flush on the nose flanges 22 and the front of the body adjacent the nose. With the shield in this position on the body, the L-shaped lugs are bent inwardly toward the connector body to form 90 degree bends at creases 62 and 64 so that covers 56 rest on the ends of nose flanges 22, tabs 58 abut the rear surfaces of the flanges and the circuit board flanges 24 are sandwiched between the circuit board mounting tabs 46 and connector block tabs 60. With the shield formed in this manner, holes 48 and 68 are in line with mounting holes (not illustrated) formed through the circuit board flanges 24 and holes 44 and mounting holes in the nose flanges 22 (not illustrated) are in alignment with screw stars 70.

Following mounting of the radio frequency shield 36 on the connector block 12 as described, the block and shield may be positioned on the board 14 with terminal tails extending through circuit board holes and the front board edge 26 located approximately flush with the front of plate 42. This position, the holes formed through tabs 46 and 60 and flanges 24 are in line with holes formed through the circuit board 14 so that the block 12 may be physically secured to the circuit board by suitable fasteners 72 as shown in FIG. 1. The fasteners 72 may be of a conventional type such as rivets, nuts and bolts, and the like.

The shield is secured to the front of the connector block 12 by mounting screws 74 having thread shafts (not illustrated) which extend through mounting holes 44, the aligned holes formed in flanges 22 and threadably engage the screw stars 70 on the back of the flanges 22 to clamp the shield to the block with the barrel 38 surrounding nose 20. In some applications the nose and barrel extend through an opening formed in a shield panel with screws 74 also extending through mounting holes formed in the panel so that panel is sandwiched against the outer surface of plate 42. The heads of screws 74 are threaded to receive mounting screws for plug connector 16.

Figure 2:
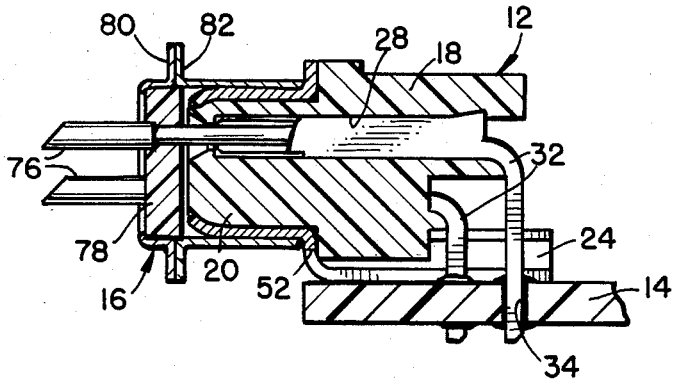
FIG. 2 is a sectional view taken along line 2—of FIG. 1.

Connector 16 is of conventional design and includes two rows of contacts 76 adapted to be secured to appropriate electrical conductors, such as the conductors in a ribbon cable. The contacts are mounted in an insulating base 78 which in turn is surrounded by metal shells 80 and 82. Shell 82 facing block 12 conforms to the outer configuration of barrel 38 so that upon movement of the plug connector toward the connector block the shell engages the barrel and orients the connector to assure that with further movement toward the block the pin ends of contacts 76 extend into openings 30 and form desired electrical connections with terminals 32 as illustrated in FIG. 2. The plug connector is held in engagement with the connector block by screws 84 which extend through mounting openings 86 in shells 80 and 82 and engage the threaded recesses in the heads of screws 74 as indicated in FIG. 1.

Fasteners 72 hold the block flush on the circuit board and assure a ground electrical connection between the shield and printed circuitry on the board. Preferrably, tabs 46 rest on the ground circuitry. The tight sliding connection between the shell 82 surrounding the pin ends of contacts 76 and the extruded barrel 38 forms a ground electrical connection and assures that the shells 80 and 82 are also grounded to provide an effective radio frequency shield surrounding the inner connections between terminals 32 and contacts 76. In the event the nose of block 12 extends through an opening in a metal mounting panel, as previously described, screws 74 assure that the panel also is maintained at ground potential.

If desired, the ground connection for the shield may be provided by a solder tab extending from a tab 46 or 60 into a circuit board hole. Wave soldering of the board 14 forms a soldered connection between the tab and ground circuitry on the board.

The recess 52 in the preform raises the edge of the plate 42 above the top of board 14 to reduce the likelihood of solder wicking under the block during wave soldering.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A shielded connector block including an insulating body having an elongate nose, a nose flange to either end of the nose, circuit board flanges on either side of the body joining the nose flanges, and a plurality of terminal recesses extending from the face of the nose through the body; terminals in the terminal recesses for making electrical connections with contacts inserted through the face of the nose and into the ends of the recesses; a unitary metal radio frequency interference ground shield including a mounting plate on the nose flanges, a barrel extending outwardly from the plate and surrounding the nose, and mounting lugs extending from the plate at opposite ends of the barrel; each lug including a flange cover extending across the adjacent nose flange, a nose flange mounting tab on the back of the nose flange and a circuit board flange mounting tab extending at right angles from the nose flange mounting tab on top of a circuit board flange; mounting holes extending through the plate, the nose flanges, circuit board flanges, the circuit board flange mounting tabs and the nose flange mounting tabs; means for connecting the shield to ground circuitry, whereby the shield may be physically secured to the body by mounting means extending through the mounting holes in the plate, nose flanges and nose flange mounting tabs and the block may be secured to a circuit board by mounting means extending through the mounting holes in the circuit board flange mounting tabs and the circuit board flanges.

2. A connector block as in claim 1 wherein the shield includes two circuit board tabs extending from the plate at opposite ends of the barrel and at right angles from the plate beneath the circuit board flanges; and mounting holes formed in the circuit board tabs in alignment with the mounting holes in the circuit board flanges and circuit board flange mounting tabs.

3. A connector block as in claim 2 wherein said lugs extend from the longitudinal ends of the plate and the flange covers overlie the longitudinal ends of the nose flanges.

4. A connector block as in claim 3 wherein said shield to ground connecting means comprises the surface of one circuit board tab located away from the adjacent circuit board flange.

5. A connector block as in claim 3 including a recess in the shield plate between the circuit board tabs for preventing solder from wicking beneath the block during wave soldering.

6. A stamped metal radio frequency interference preform for mounting on a connector block; the preform including a flat plate, an extruded barrel projecting from one side of the plate and extending axially along the plate, and an L-shaped mounting lug on each end of the plate; each lug including a flange end cover joining an end of the plate, a nose flange mounting tab joining the cover outwardly of the end of the plate and a circuit board flange mounting tab joining the nose flange mounting tab on one edge thereof; mounting holes formed through the ends of the plate, the circuit board flange mounting tabs and the nose flange mounting tabs.

7. A preform as in claim 6 including circuit board tabs extending from one edge of the plate adjacent the ends thereof; said circuit board flange mounting tabs and circuit board tabs both extending in the same direction; and mounting holes formed through the circuit board tabs.

8. A preform as in claim 7 including crease lines formed at the junctions between the plate and flange end covers, the flange end covers and the nose flange mounting tabs, the nose flange mounting tabs and the circuit board flange mounting tabs and the plate and the circuit board tabs; the crease lines at the flange end covers extending in a direction perpendicular to the longitudinal axis of the barrel and the crease lines at the mounting tabs extending parallel to the longitudinal axis of the barrel; all of said crease lines being on the other side of the preform, away from the barrel.

* * * * *